US008979298B1

(12) United States Patent
Wang

(10) Patent No.: US 8,979,298 B1
(45) Date of Patent: Mar. 17, 2015

(54) FLASHLIGHT WITH SIDELIGHT STRUCTURE

(71) Applicant: Day Sun Technology Ltd., Tainan (TW)

(72) Inventor: Shih-Hao Wang, Tainan (TW)

(73) Assignee: Day Sun Technology Ltd., Tainan (TW)

( * ) Notice: Subject to any disclaimer, the term of this patent is extended or adjusted under 35 U.S.C. 154(b) by 0 days.

(21) Appl. No.: 14/105,256

(22) Filed: Dec. 13, 2013

(51) Int. Cl.
*F21L 4/02* (2006.01)

(52) U.S. Cl.
CPC ..... *F21L 4/02* (2013.01)
USPC ..... 362/184; 362/249.13; 362/205

(58) Field of Classification Search
USPC ..... 362/184, 190, 202, 205, 249.01, 362/249.12, 249.13
See application file for complete search history.

(56) References Cited

U.S. PATENT DOCUMENTS 6,099,141 A * 8/2000 Landamia ..... 362/184
6,623,140 B2 * 9/2003 Watterson et al. ..... 362/184
7,651,240 B2 * 1/2010 Bayat et al. ..... 362/208

* cited by examiner

*Primary Examiner* — Thomas M Sember
(74) *Attorney, Agent, or Firm* — Alan D. Kamrath; Kamrath IP Lawfirm, P.A.

(57) ABSTRACT

A flashlight with a sidelight structure is provided and is for use in illumination in dim environments or at night. A sidelight is peripherally disposed at a predetermined position on the flashlight and emits light in a second direction different from the direction of light emitted from a frontlight of the flashlight such that, depending on the required direction of irradiation, a user presses a frontlight switch to turn on the frontlight or presses a sidelight switch to turn on the sidelight. Therefore, the flashlight provides illumination broadly and flexibly.

3 Claims, 6 Drawing Sheets

FLASHLIGHT WITH SIDELIGHT STRUCTURE

BACKGROUND OF THE INVENTION

1. Technical Field

The present invention relates to flashlights with a sidelight structure, and more particularly, to a flashlight with a sidelight structure. The flashlight with a sidelight structure provides illumination in dim environments or at night. A sidelight is peripherally disposed at a predetermined position on the flashlight with a sidelight structure and emits light in a second direction different from the direction of light emitted from a frontlight of the flashlight with a sidelight structure such that, depending on the required direction of irradiation, a user presses a frontlight switch to turn on the frontlight or presses a sidelight switch to turn on the sidelight. Therefore, the flashlight with a sidelight structure provides illumination broadly and flexibly.

2. Description of Related Art

Existing flashlights come in diverse categories. Structure and forms of the existing flashlights vary with their purposes. Illumination-oriented flashlights are required to meet safety standards (UL)—be ventilated when operating, and be waterproof when idle.

The existing flashlights each essentially comprises: a hollow-cored gripping portion; an opening disposed at one end of the hollow-cored gripping portion and adapted to admit and hold a required battery; a power switch disposed at a predetermined position on the gripping portion; a frontlight disposed at the front end of the gripping portion; a reflector insertedly disposed around the gripping portion and corresponding in position to the frontlight; and a transparent cap rotatably fastened to a thread segment at the front end of the gripping portion. Illumination-oriented flashlights provide illumination in dim environments or at night.

The existing flashlights emit light in one direction only. To have light emitted in another direction, a user has to change the predetermined irradiation direction of the flashlights. The present invention improves on the prior art by providing a flashlight with a frontlight and a sidelight to thereby provide illumination broadly and flexibly in dim environments or at night

BRIEF SUMMARY OF THE INVENTION

The present invention improves on conventional flashlights which are restricted to unidirectional irradiation. A sidelight is peripherally disposed at a predetermined position on a flashlight of the present invention and emits light in a second direction different from the direction of light emitted from a frontlight of the flashlight such that, depending on the required direction of irradiation, a user presses a frontlight switch to turn on the frontlight or presses a sidelight switch to turn on the sidelight. Therefore, the flashlight of the present invention provides illumination broadly and flexibly.

The first objective of the present invention is to provide a flashlight for use in illumination. The flashlight comprises a hollow-cored gripping portion, a battery holding unit insertable into the gripping portion, a frontlight unit disposed at the front end of the battery holding unit, a reflector insertedly disposed around the front end of the battery holding unit, and a transparent cap rotatably fastened to an external thread at the front end of the gripping portion. At least a sidelight is disposed laterally at a predetermined position on the battery holding unit, wherein a through-hole corresponding in position to the at least a sidelight is peripherally disposed at the gripping portion and thus receivingly coupleable to a transparent sidelight cover, wherein upper and lower holes are peripherally disposed at the gripping portion, opposite to the through-hole, and receivingly coupleable to a frontlight switch and a sidelight switch for controllably switching between ON/OFF of a frontlight source and a sidelight source. A user selectively presses the frontlight switch to turn on a frontlight or presses the sidelight switch to turn on a sidelight in accordance with an intended direction of irradiation, such that the flashlight provides illumination broadly and flexibly.

The second objective of the present invention is to provide a flashlight with a sidelight structure, wherein a space in communication with the inside of the gripping portion is defined peripherally at the gripping portion, positioned at a predetermined position, and adapted to hold a ventilation unit for discharging appropriately heat generated as a result of operation of the flashlight.

The third objective of the present invention is to provide a flashlight with a sidelight structure, wherein recognition labels indicative of the forward and sideward directions of intended irradiation are disposed on the frontlight switch and the sidelight switch disposed laterally on the gripping portion, respectively.

DETAILED DESCRIPTION OF THE INVENTION

Figure 2:
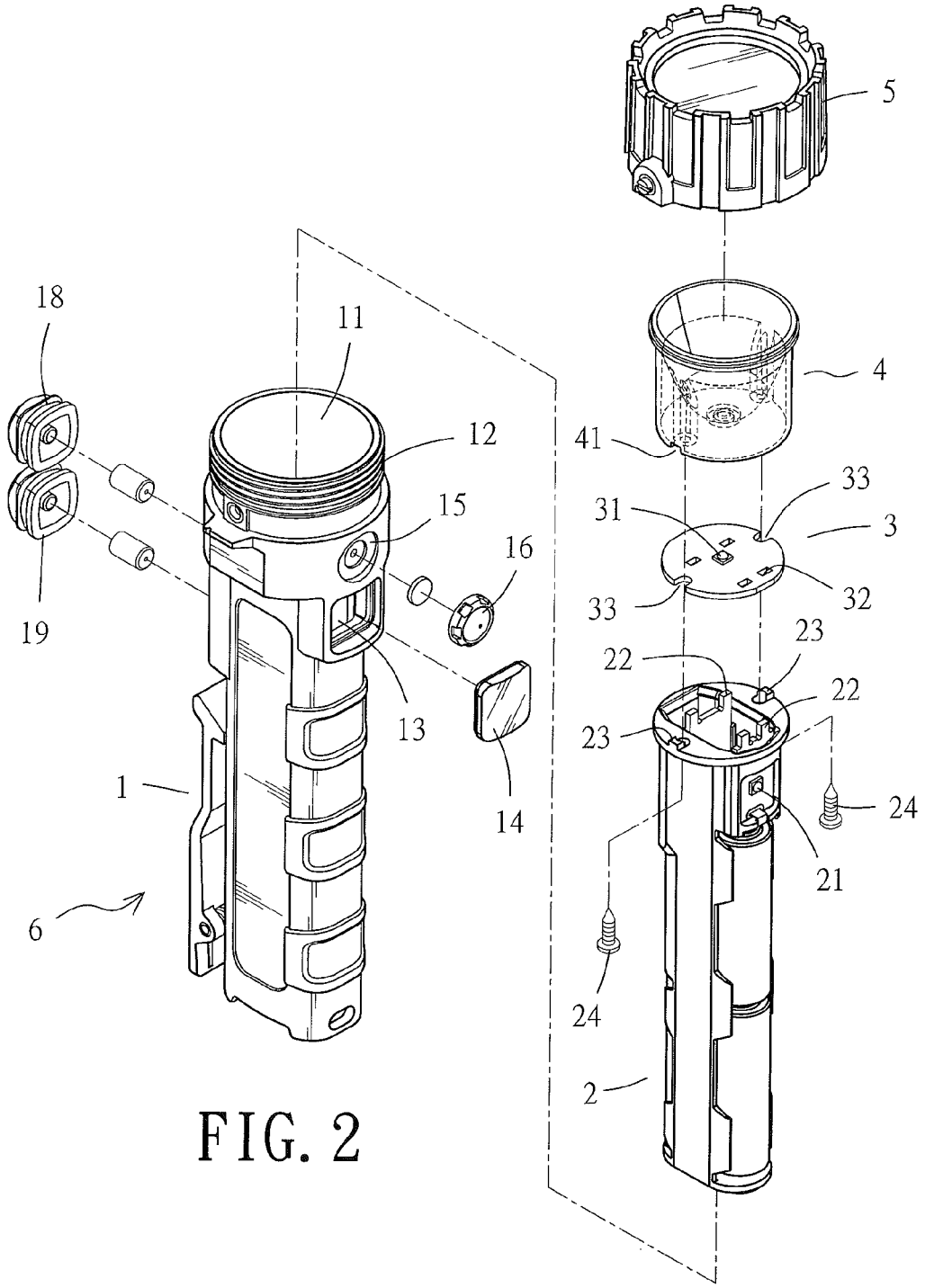
FIG. 2 is an exploded view of the flashlight viewed from an angle according to the present invention.
Figure 3:
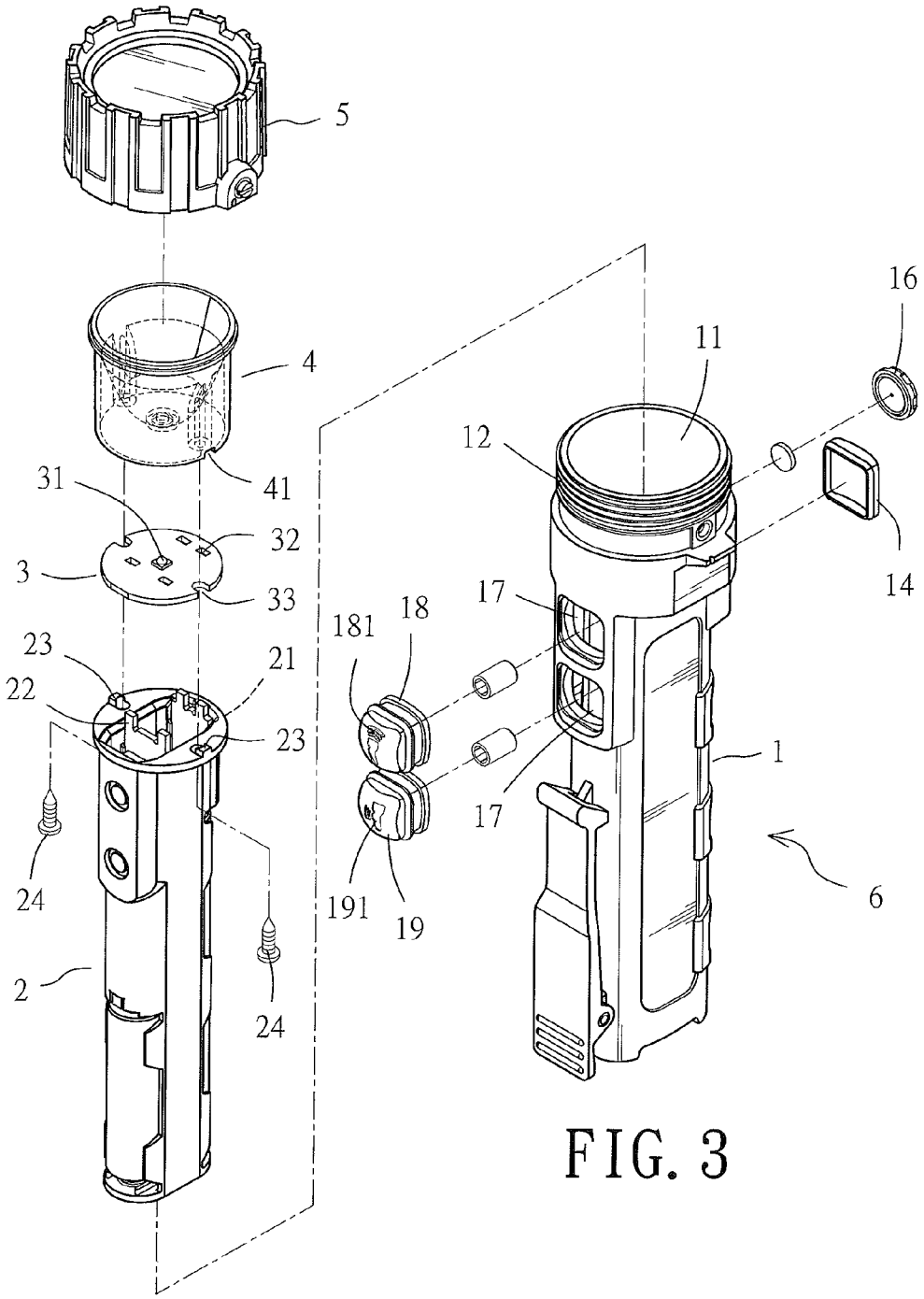
FIG. 3 is an exploded view of the flashlight viewed from another angle according to the present invention.

A flashlight 6 with a sidelight structure (as shown in FIGS. 2, 3) is provided by the present invention and comprises a hollow-cored gripping portion 1, a battery holding unit 2 insertable into the gripping portion 1, a frontlight unit 3 disposed at the front end of the battery holding unit 2, a reflector 4 insertedly disposed around the front end of the battery holding unit 2, and a transparent cap 5 rotatably fastened to an external thread at the front end of the gripping portion 1.

The gripping portion 1 is hollow-cored and serves as the basic gripping part of the flashlight 6. An external thread 12 is formed at the outer rim of an opening 11 at the front end of the gripping portion 1. A through-hole 13 (shown in FIG. 2) penetratingly and peripherally disposed at a predetermined position on the gripping portion 1 and thus receivingly coupleable to a transparent sidelight cover 14. A space 15 in communication with the inside of the gripping portion 1 is defined peripherally at the gripping portion 1, positioned proximate to the sidelight cover 14, and adapted to hold a ventilation unit 16 for dissipating appropriately heat generated as a result of operation of the flashlight 6. Upper and lower holes 17 (shown in FIG. 3) are peripherally disposed at the gripping portion 1, opposite to the through-hole 13, and receivingly coupleable to a frontlight switch 18 and a sidelight switch 19 for controllably switching between ON/OFF of a frontlight source and a sidelight source. Recognition labels 181, 191 indicative of the forward and sideward directions of intended irradiation are disposed on the frontlight switch 18 and the sidelight switch 19, respectively.

The battery holding unit 2 effectuates the confinement of a battery in accordance with the internal space of the gripping portion 1. At least a sidelight 21 is disposed laterally at a predetermined position on the battery holding unit 2. A plurality of abutting segments 22 extends from the space at the front end of the battery holding unit 2 to enable the frontlight unit 3 to be positioned. An intercepting protruding portion 23 is disposed on each of the two opposing sides at the front end of the battery holding unit 2 to enable the reflector 4 to be positioned.

The constituent elements of the frontlight unit 3 are designed in accordance with the front end of the battery holding unit 2. At least a frontlight 31 is disposed at a predetermined position on the frontlight unit 3. A plurality of apertures 32 penetrates the frontlight unit 3. The apertures 32 are engaged with the abutting segments 22 of the battery holding unit 2, respectively. Notches 33 are concavely disposed on the two opposing sides of the frontlight unit 3 and engaged with the intercepting protruding portions 23 of the battery holding unit 2, respectively.

The reflector 4 is disposed at the front end of the battery holding unit 2 and adapted to divert light beams emitted from the frontlight. Notches 41 are concavely disposed at the periphery of the rear portion of the reflector 4 and engaged with the intercepting protruding portions 23 of the battery holding unit 2, respectively, to impose a directional limitation on the reflector 4 relative to the battery holding unit 2.

The transparent cap 5 is disposed at an external thread 12 at the front end of the gripping portion 1 and adapted to enclose the frontlight. A thread segment is formed at the inner rim of the transparent cap 5 to mesh with an external thread 12 at the front end of the gripping portion 1, such that the transparent cap 5 is rotatably fastened to the gripping portion 1.

Figure 1:
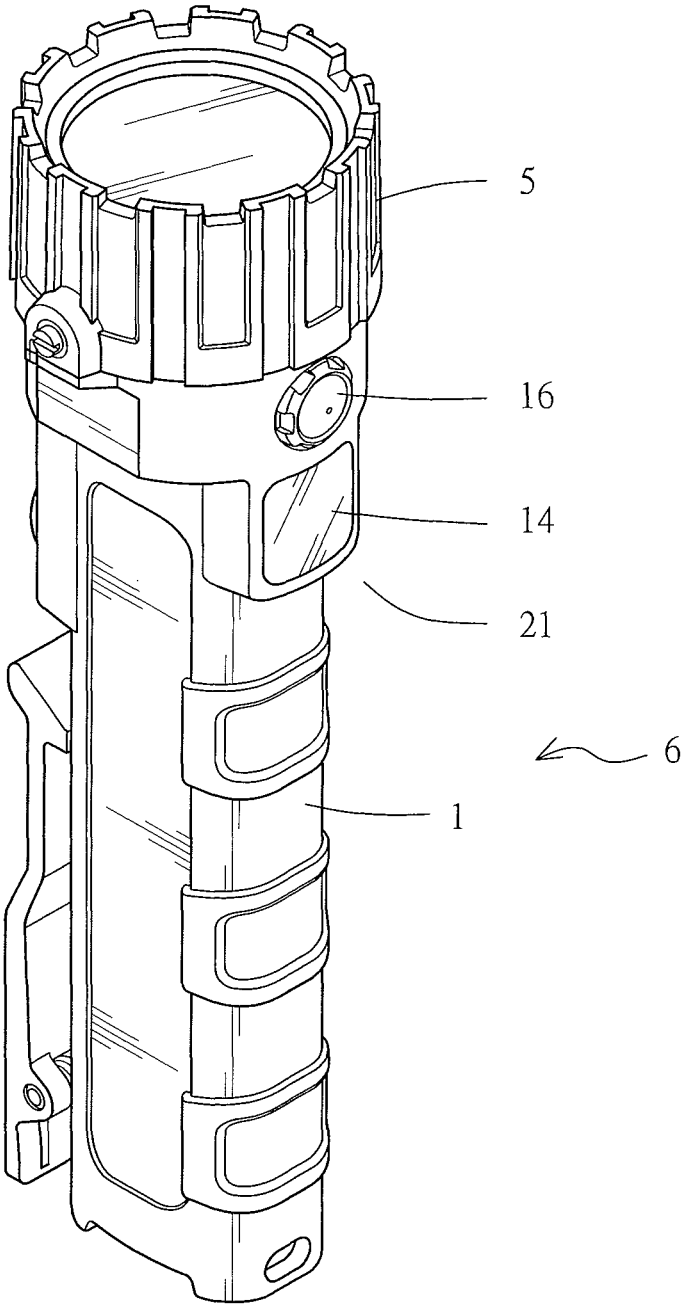
FIG. 1 is a perspective view of an assembled flashlight with sidelight according to the present invention.

To put together the gripping portion 1, the battery holding unit 2, the frontlight unit 3, the reflector 4, and the transparent cap 5, it is necessary to follow the steps of a procedure illustrated with FIG. 2, FIG. 3 and described as follows: inserting the battery holding unit 2 into the internal space of the gripping portion 1; engaging the frontlight unit 3 with the abutting segments 22 of the battery holding unit 2; engaging the reflector 4 with the intercepting protruding portions 23 of the battery holding unit 2 to impose a directional limitation on the reflector 4 relative to the battery holding unit 2; screwing the reflector 4 to the front of the battery holding unit 2 by means of screwing elements 24; and rotatably fastening the transparent cap 5 to an external thread 12 of the gripping portion 1. Upon completion of the procedure, assembly of the flashlight 6 with a sidelight structure (as shown in FIG. 1) is done.

Figure 4:
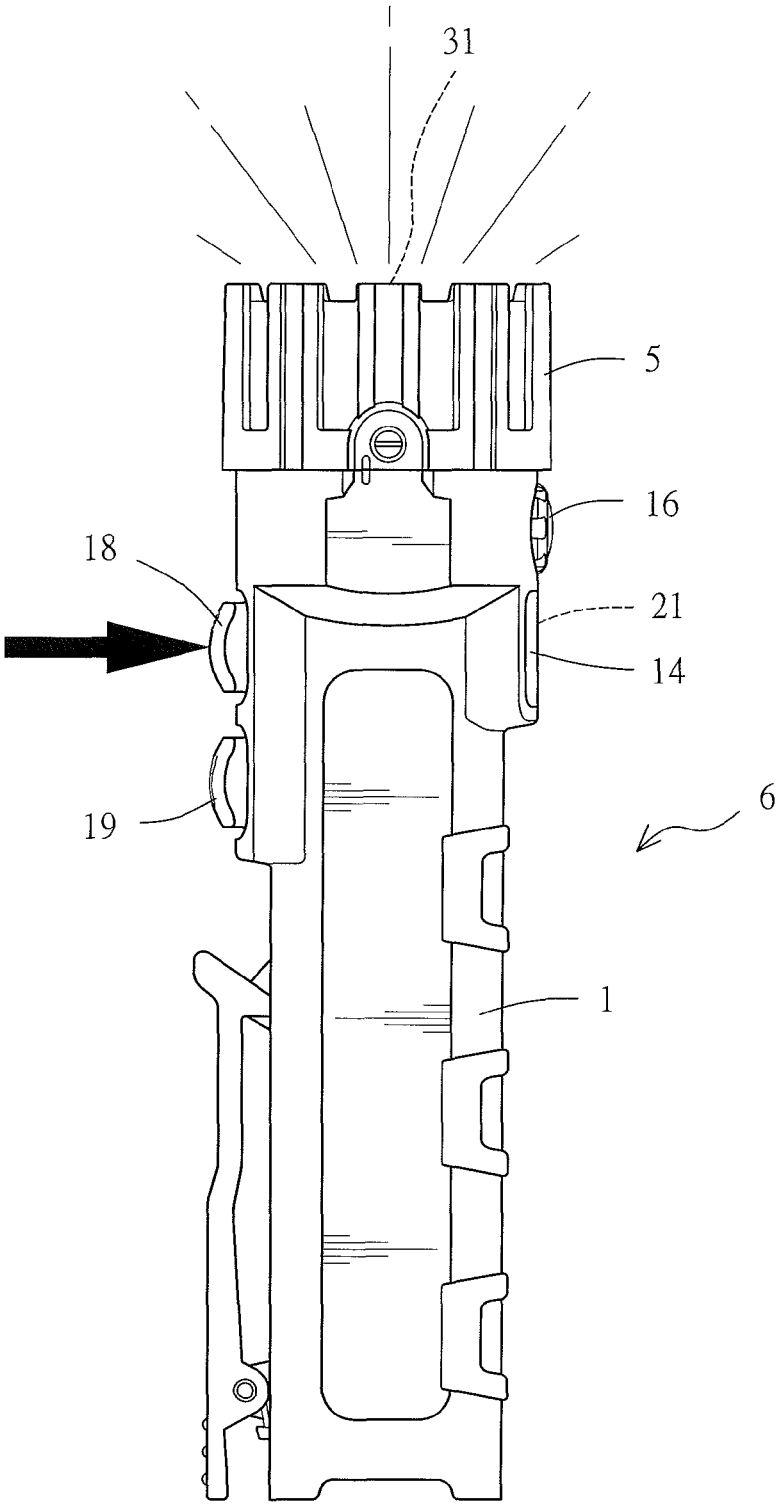
FIG. 4 is a schematic view of the flashlight button-pressed to turn on a frontlight according to the present invention.
Figure 6:
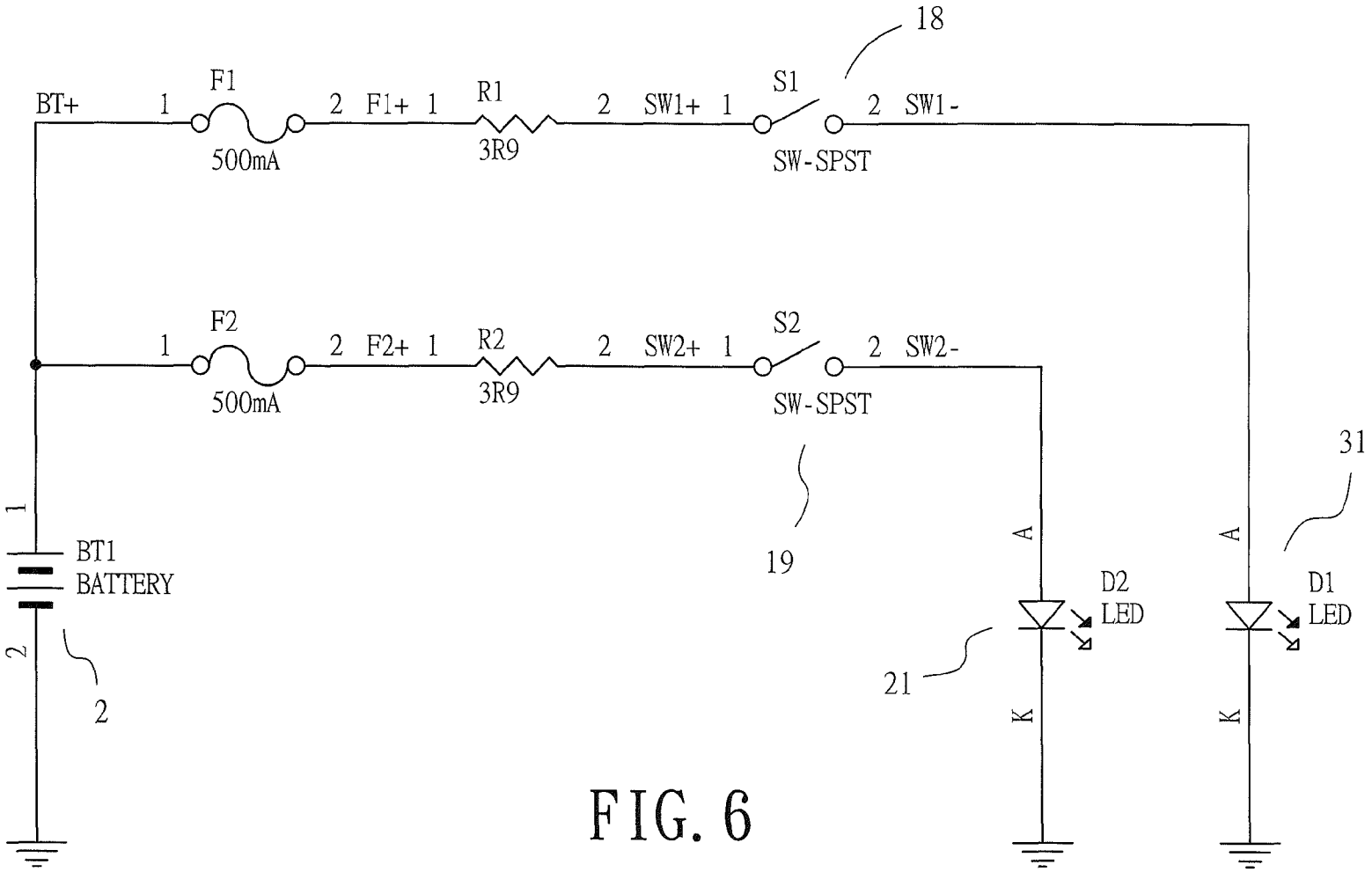
FIG. 6 is a circuit diagram of the frontlight and the sidelight of the flashlight according to the present invention.

To turn on the at least a frontlight 31 of the flashlight 6 (as shown in FIGS. 4, 6), a user uses his or her finger to press the frontlight switch 18 of the gripping portion 1 of the flashlight 6 and thereby turn on the at least a frontlight 31 through a wire connected to the frontlight unit 3. The reflector 4 serves to forward light beams emitted from the at least a frontlight 31.

Figure 5:
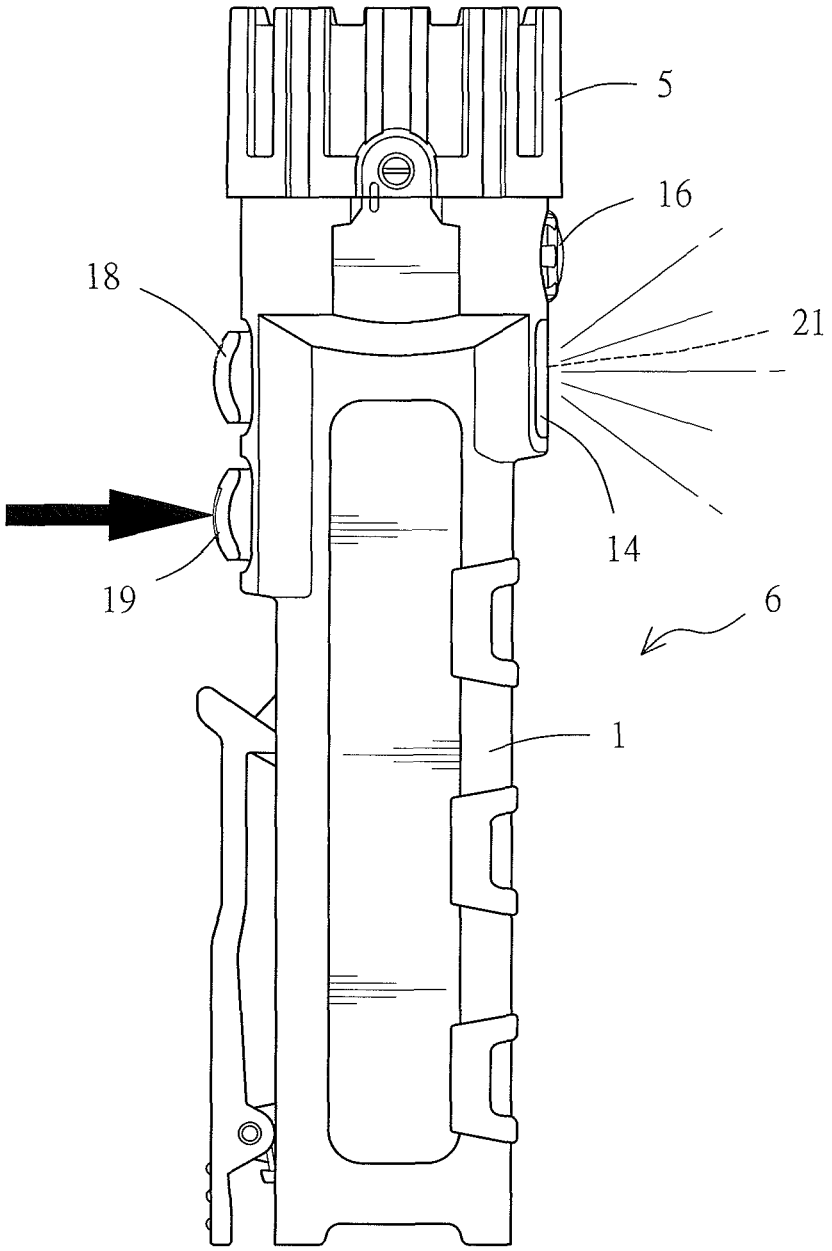
FIG. 5 is a schematic view of the flashlight button-pressed to turn on a sidelight according to the present invention.

To turn on the at least a sidelight 21 of the flashlight 6 (as shown in FIGS. 5, 6), the user uses his or her finger to press the sidelight switch 19 of the gripping portion 1 of the flashlight 6 and thereby turn on the at least a sidelight 21 disposed laterally on the flashlight 6 through a wire connected to the at least a sidelight 21, such that the at least a sidelight 21 emits light sideway in a predetermined direction. Hence, the user selectively presses the frontlight switch 18 to turn on the at least a frontlight 31 or presses the sidelight switch 19 to turn on the at least a sidelight 21 in accordance with the intended direction of irradiation, such that the flashlight 6 provides illumination broadly and flexibly.

Furthermore, when the at least a frontlight 31 or the at least a sidelight 21 of the flashlight 6 is operating, heat generated from internal constituent elements (including a battery, a frontlight, and a sidelight) of the flashlight 6 is appropriately discharged to the surroundings by means of the ventilation unit 16 disposed laterally on the flashlight 6, so as to prevent the internal constituent elements (including a battery, the at least a frontlight 31, and the at least a sidelight 21) of the flashlight 6 from hazards which might otherwise happen to the flashlight 6 because of overheat and prevent reduction of the service life of the flashlight 6.

What is claimed is:

1. A flashlight with a sidelight structure, comprising a hollow-cored gripping portion, a battery holding unit insertable into the gripping portion, a frontlight unit disposed at a front end of the battery holding unit, a reflector insertedly disposed around the front end of the battery holding unit, and a transparent cap rotatably fastened to an external thread at a front end of the gripping portion, wherein at least a sidelight is disposed laterally at a predetermined position on the battery holding unit, wherein a through-hole corresponding in position to the at least a sidelight is peripherally disposed at the gripping portion and thus receivingly coupleable to a transparent sidelight cover, wherein upper and lower holes are peripherally disposed at the gripping portion, opposite to the through-hole, and receivingly coupleable to a frontlight switch and a sidelight switch for controllably switching between ON/OFF of a frontlight source and a sidelight source, wherein a user selectively presses the frontlight switch to turn on a frontlight or presses the sidelight switch to turn on a sidelight in accordance with an intended direction of irradiation, such that the flashlight provides illumination broadly and flexibly.

2. The flashlight with a sidelight structure as recited in claim 1, wherein a space in communication with an inside of the gripping portion is defined peripherally at the gripping portion, positioned at a predetermined position, and adapted to hold a ventilation unit for discharging appropriately heat generated as a result of operation of the flashlight.

3. The flashlight with a sidelight structure as recited in claim 1, wherein recognition labels indicative of forward and sideward directions of intended irradiation are disposed on the frontlight switch and the sidelight switch disposed laterally on the gripping portion, respectively.

* * * * *